US011117243B1

(12) United States Patent
Brown et al.

(10) Patent No.: US 11,117,243 B1
(45) Date of Patent: Sep. 14, 2021

(54) MULTI-TOOL FOR DISRUPTER BREECH MAINTENANCE

(71) Applicant: The United States of America As Represented by the Secretary of Navy, Indian Head, MD (US)

(72) Inventors: Lance A. Brown, King George, VA (US); David G. Banks, White Plains, MD (US); Keith Chamberlain, Waldorf, MD (US); Lonnie Frericks, King George, VA (US); Scott Steward, Accokeek, MD (US)

(73) Assignee: The United States of American as represented by the Secretary of the Navy, Washington, DC (US)

( * ) Notice: Subject to any disclaimer, the term of this patent is extended or adjusted under 35 U.S.C. 154(b) by 380 days.

(21) Appl. No.: 16/501,560

(22) Filed: May 1, 2019

(51) Int. Cl.
*B25B 13/06* (2006.01)
*B25B 13/48* (2006.01)
*B25G 1/08* (2006.01)

(52) U.S. Cl.
CPC ..... *B25B 13/065* (2013.01); *B25B 13/48* (2013.01); *B25G 1/085* (2013.01)

(58) Field of Classification Search
CPC ..... B25B 13/065; B25B 13/48; B25F 1/02; F41C 27/00
See application file for complete search history.

(56) References Cited

U.S. PATENT DOCUMENTS

| | | | | |
|---|---|---|---|---|
| 1,281,438 | A | 10/1918 | Tuttle | |
| 2,453,901 | A | 11/1948 | Gonsett et al. | |
| 3,680,159 | A | 8/1972 | Wharram | |
| 5,016,380 | A * | 5/1991 | Jones | B25F 1/02 42/90 |
| 6,705,183 | B1 | 3/2004 | Dickens | |
| 7,293,312 | B2 * | 11/2007 | Chmelar | A63C 17/0006 7/138 |
| 8,091,266 | B2 | 1/2012 | Huang | |
| 8,850,738 | B2 | 10/2014 | Silver | |
| 9,498,870 | B2 * | 11/2016 | Davis | B25B 27/0071 |
| 9,784,520 | B2 * | 10/2017 | Geissele | B25B 13/50 |
| 9,857,138 | B2 * | 1/2018 | Geissele | B25B 13/04 |
| 10,478,957 | B1 * | 11/2019 | Keele | B25B 13/06 |
| 2017/0157749 | A1 * | 6/2017 | Levy | B25B 13/481 |
| 2018/0071906 | A1 * | 3/2018 | Neubauer | B25B 15/005 |
| 2019/0285377 | A1 * | 9/2019 | Jacobson | F41A 11/00 |

* cited by examiner

*Primary Examiner* — David B. Thomas
(74) *Attorney, Agent, or Firm* — Fredric J. Zimmerman

(57) ABSTRACT

A multi-tool for disrupter breech maintenance includes an elongate body having a first axial end and a second axial end. The elongate body encases a storage volume commencing at and accessible from the second axial end. An open-ended rectangular notch in a radial wall of the elongate body has a planar base. A hole extends radially through the elongate body with the hole originating in the notch's planar base and having a longitudinal axis perpendicular to the planar base. A rectangular well in the radial wall of the elongate body is provided adjacent to the rectangular notch. A first hexagonal socket is coupled to the first axial end of the elongate body. A second hexagonal socket is provided for attachment to the second axial end of the elongate body.

15 Claims, 2 Drawing Sheets

MULTI-TOOL FOR DISRUPTER BREECH MAINTENANCE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to combination or compound tools, and more particularly to a multi-tool for use in maintenance of disrupter breeches.

BACKGROUND OF THE INVENTION

Routine maintenance on the breech of a disrupter firearm typically requires a variety of sockets and their ratchet bar/handle, a gauge for testing the linearity of the disrupter's firing pin, a tool for evaluating the correct size and shape of the firing pin's spring, as well as availability of spare parts and/or other implements for a particular repair. Unfortunately, it is time consuming to collect the needed tools/parts needed for disrupter breech maintenance.

SUMMARY OF THE INVENTION

Accordingly, it is an object of the present invention to provide a single, multi-tool that can be used for maintenance on a disrupter breech.

Other objects and advantages of the present invention will become more obvious hereinafter in the specification and drawings.

In accordance with the present invention, a single, multi-tool is provided for disrupter breech maintenance. The multi-tool includes an elongate body having a first axial end and a second axial end. The elongate body encases a storage volume commencing at and accessible from the elongate body's second axial end. An open-ended rectangular notch is in a radial wall of the elongate body. The rectangular notch has a planar base. A hole extends radially through the elongate body. The hole originates in the notch's planar base and has a longitudinal axis perpendicular to the planar base. A rectangular well in the radial wall of the elongate body is provided adjacent to the rectangular notch. A first hexagonal socket is coupled to the first axial end of the elongate body. A second hexagonal socket is provided for attachment to the second axial end of the elongate body.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
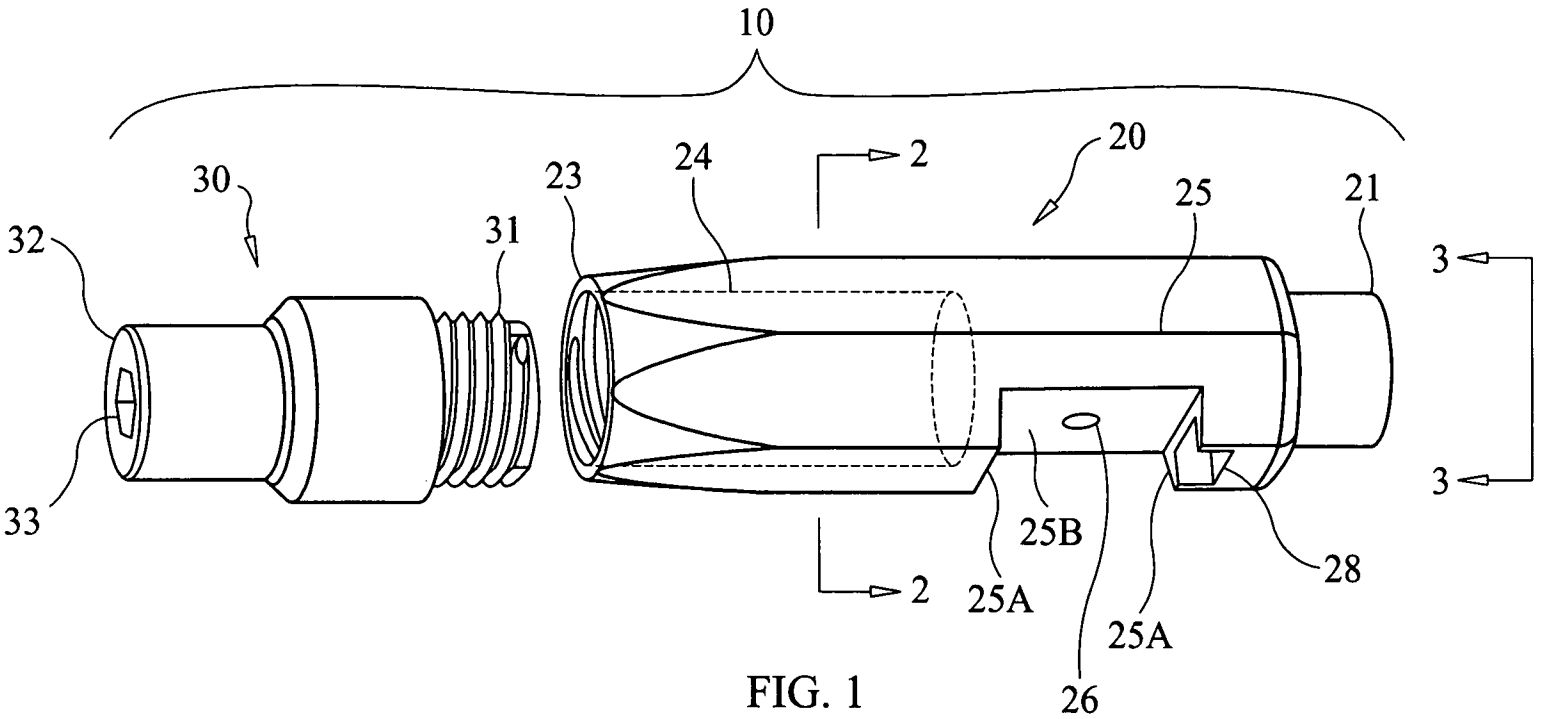
FIG. 1 is an exploded perspective view of a multi-tool for disrupter breech maintenance in accordance with an embodiment of the present invention.

Referring now to the drawings, simultaneous reference will be made to FIGS. 1-4 in order to describe a multi-tool for disrupter breech maintenance in accordance with an exemplary embodiment of the present invention. FIG. 1 depicts the entire multi-tool in an exploded view where the multi-tool is referenced generally by numeral 10.

Multi-tool 10 includes an elongate body 20 and a hexagonal socket attachment 30. Elongate body 20 and socket attachment 30 will generally be made from rigid materials such as a metal. The choice of materials used for multi-tool 10 as well as the methods to fabricate multi-tool 10 is not a limitation of the present invention.

Elongate body 20 may be fabricated as a single integrated element to have the features shown and described herein. Elongate body 20 has a first axial end 21 terminating in a hexagonal socket 22 (FIG. 3). The size of socket 22 is not a limitation of the present invention. The opposing axial end 23 is open to provide access to an interior storage volume 24 (FIG. 2) encased by elongate body 20. Storage volume 24 may be used to store spare parts or other miscellaneous implements needed for breech maintenance. Axial end 23 may be threaded on its interior (as shown) or exterior to facilitate attachment of socket attachment 30 that, when accomplished, seals storage volume 24.

Elongate body 20 includes additional features needed for disrupter breech maintenance. For example, an open-ended rectangular notch 25 is provided in a radial wall of elongate body 20 near axial end 21. Notch 25 effectively defines a wrench flat having sidewalls 25A and a planar base 25B. Notch 25 is sized to cooperate with protective "ears" (not shown) generally found on a disrupter breech. These "ears" protect the breech's integral parts from damage caused when the disrupter is fired and/or when the breech impacts hard surfaces. By placing notch 25 near axial end 21, the remainder of elongate body 20 serves as a wrench handle.

Figure 2:
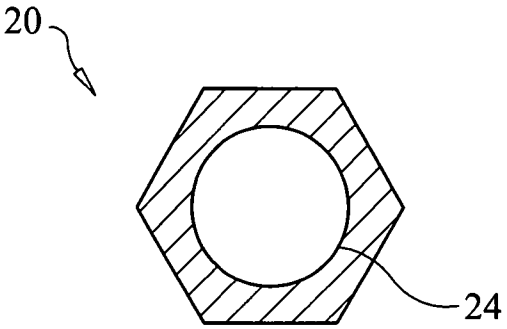
FIG. 2 is a cross-sectional view of the multi-tool's elongate body taken along line 2-2 in FIG. 1.
Figure 3:
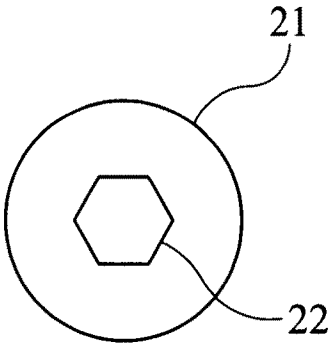
FIG. 3 is an end view of the multi-tool's elongate body taken along line 3-3 in FIG. 1.

In addition to inclusion of notch 25 for use as a wrench, at least some portion of elongate body 20 may have a cross-section whose perimeter is hexagonal as illustrated in FIG. 2. In this way, elongate body 20 may be gripped by a wrench, pliers, etc., (not shown) in order to facilitate axial rotation of elongate body 20 when the socket features of multi-tool 10 are used.

Figure 4:
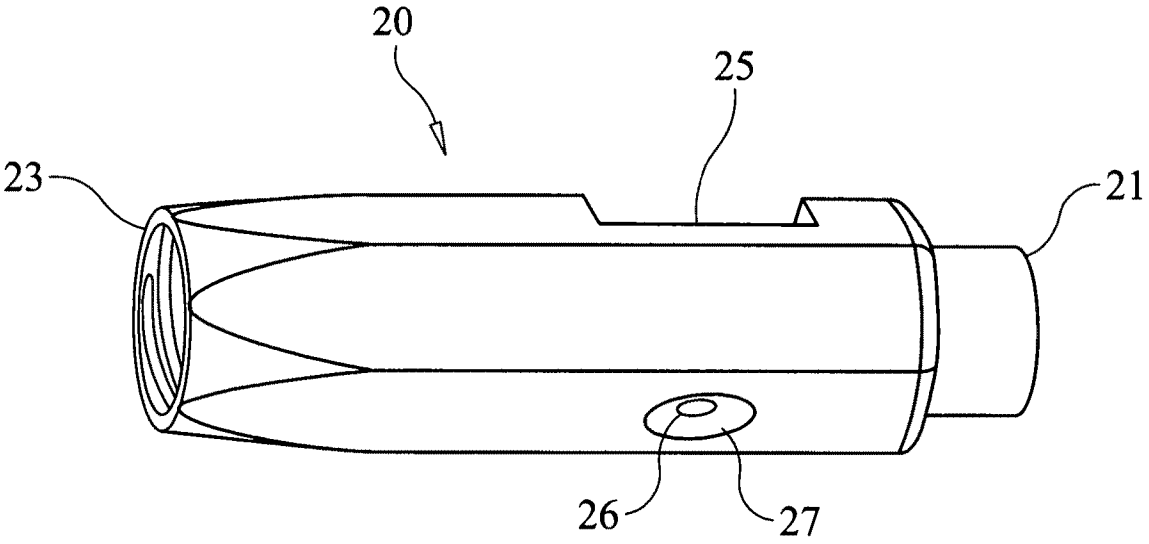
FIG. 4 is a perspective view of the multi-tool's elongate body from FIG. 1 following an 180° axial rotation of the elongate body.

Elongate body 20 also includes features to facilitate testing of important elements of a disrupter breech. More specifically, elongate body 20 includes a gauge for testing the linearity or "trueness" of a breech disrupter's firing pin (not shown), and includes a gauge for testing the size and shape of a firing pin spring (not shown). The multi-tool's firing pin gauge is provided by a pass-through gauge hole 26 that originates in planar base 25B (e.g., in the center of planar base 25B as shown), extends radially through elongate body 20, and exits elongate body 20 in radial opposition to planar base 25B (FIG. 4). In order to properly test for linearity of a firing pin, gauge hole 26 is sized to provide a slidingly fit with a straight firing pin. More specifically, an undamaged straight firing pin will readily move through gauge hole 26. However, a damaged or bent firing pin will tend to get stuck in gauge hole 26. To facilitate removal of a damaged firing pin from gauge hole 26, a depressed region 27 (FIG. 4) of elongate body 20 disposed annularly about the exit portion of hole 26 may be provided to facilitate the removal of a damaged firing pin. Thus, gauge hole 26 provides an instantaneous "go/no go" test response for a firing pin.

The multi-tool's spring gauge is provided by a rectangular well 28 that, in the illustrated exemplary embodiment, adjoins notch 25. Rectangular well 28 is sized commensurate with a firing pin's coil spring that is still within tolerance in terms of size (i.e., not stretched out) and shape (i.e., still cylindrical and not curved or bent). That is, a damaged firing pin spring will not fit in rectangular well 28 thereby allowing rectangular well 28 to provide an instantaneous "go/no go" test response for a firing pin spring.

Hexagonal socket attachment 30 is threaded at one axial end 31 for threaded engagement with axial end 23 of elongate body 20. The opposing axial end 32 of socket attachment 30 has a hexagonal socket 33 that is generally sized differently than socket 22. The particular size of socket 33 is not a limitation of the present invention.

The advantages of the present invention are numerous. The single, multi-tool provides the tools needed to disassemble and re-assemble a disrupter breech. Spare parts and/or other needed implements may be kept in the multi-tool's storage volume. The multi-tool also includes "go/no go" gauges to test a disrupter breech's critically-important firing pin and firing pin spring.

Although the invention has been described relative to a specific embodiment thereof, there are numerous variations and modifications that will be readily apparent to those skilled in the art in light of the above teachings. For example, the elongate body's socket size, notch size, hole gauge size, and rectangular well may all be sized to work with a particular disrupter. Further, the socket attachment could include threads and sockets at both axial ends to thereby increase the versatility of the multi-tool. Lanyard attachment points or holes may be provided on the elongate body and/or its socket attachment to allow the multi-tool to be hung easy storage and for ready access. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A multi-tool for disrupter breech maintenance, comprising:

an elongate body including a first axial end and a second axial end, said elongate body encases a storage volume commencing at and accessible from said second axial end;

an open-ended rectangular notch being in a radial wall of said elongate body, said rectangular notch includes a planar base;

a hole extending radially through said elongate body, said hole originates in said planar base, said hole includes a longitudinal axis perpendicular to said planar base;

a rectangular well in said radial wall of said elongate body being adjacent to said rectangular notch;

a first hexagonal socket being coupled to said first axial end of said elongate body; and a second hexagonal socket being configured for attachment to said second axial end of said elongate body.

2. The multi-tool as in claim 1, wherein said hole exits elongate body in radial opposition to said planar base at a depression in said elongate body.

3. The multi-tool as in claim 1, wherein a radial cross-section of a portion of said elongate body has a hexagonal perimeter.

4. The multi-tool as in claim 1, wherein said second hexagonal socket is in threaded engagement with said second axial end of said elongate body.

5. The multi-tool as in claim 1, wherein said elongate body comprises a one-piece construction.

6. The multi-tool as in claim 1, wherein said hole is centered in said planar base.

7. A multi-tool for disrupter breech maintenance, comprising:

a one-piece elongate body including a first axial end and a second axial end, said first axial end terminates in a first hexagonal socket, said second axial end terminates in an opening to provide access to a storage volume encased by said elongate body;

an open-ended rectangular notch being in a radial wall of said elongate body, said rectangular notch includes a planar base;

a hole extending radially through said elongate body, said hole originates in said planar base, said hole includes a longitudinal axis perpendicular to said planar base;

a rectangular well in said radial wall of said elongate body being adjacent to said rectangular notch; and a second hexagonal socket being configured for attachment to said second axial end of said elongate body, wherein said opening is sealed by said second hexagonal socket.

8. The multi-tool as in claim 7, wherein said hole exits elongate body in radial opposition to said planar base at a depression in said elongate body.

9. The multi-tool as in claim 7, wherein a radial cross-section of a portion of said elongate body has a hexagonal perimeter.

10. The multi-tool as in claim 7, wherein said second hexagonal socket is in threaded engagement with said second axial end of said elongate body.

11. The multi-tool as in claim 7, wherein said hole is centered in said planar base.

12. A multi-tool for disrupter breech maintenance, comprising:

an elongate body including a first axial end and a second axial end, said elongate body encases a storage volume commencing at and accessible from said second axial end;

an open-ended rectangular notch being in a radial wall of said elongate body, said rectangular notch includes a planar base;

a hole extending radially through said elongate body, said hole originates in said planar base, said hole exits elongate body in radial opposition to said planar base at a depression in said elongate body, said hole includes a longitudinal axis perpendicular to said planar base;

a rectangular well in said radial wall of said elongate body being adjacent to said rectangular notch;

a first hexagonal socket being coupled to said first axial end of said elongate body; and a second hexagonal socket being in threaded engagement with said second axial end of said elongate body.

13. The multi-tool as in claim 12, wherein a radial cross-section of a portion of said elongate body has a hexagonal perimeter.

14. The multi-tool as in claim 12, wherein said elongate body comprises one-piece construction.

15. The multi-tool as in claim 12, wherein said hole is centered in said planar base.

* * * * *